United States Patent [19]

Hernqvist

[11] Patent Number: 4,883,437

[45] Date of Patent: Nov. 28, 1989

[54] METHOD FOR SPOT-KNOCKING AN ELECTRON GUN MOUNT ASSEMBLY OF A CRT UTILIZING A MAGNETIC FIELD

[75] Inventor: Karl G. Hernqvist, Princeton, N.J.

[73] Assignee: RCA Licensing Corp., Princeton, N.J.

[21] Appl. No.: 330,015

[22] Filed: Mar. 29, 1989

Related U.S. Application Data

[63] Continuation-in-part of Ser. No. 214,556, Jun. 29, 1988, abandoned.

[51] Int. Cl.[4] ..... H01J 9/44

[52] U.S. Cl. ..... 445/5

[58] Field of Search ..... 445/5, 6

[56] References Cited

U.S. PATENT DOCUMENTS

| | | | |
|---|---|---|---|
| 3,323,854 | 6/1967 | Palac | 445/5 |
| 3,772,554 | 11/1973 | Hughes | 313/69 C |
| 4,052,776 | 10/1977 | Maskell et al. | 445/5 |
| 4,214,798 | 7/1980 | Hopen | 445/5 |
| 4,326,762 | 4/1982 | Hockenbrock et al. | 316/1 |
| 4,515,569 | 5/1985 | Hernqvist | 445/5 |
| 4,682,963 | 7/1987 | Daldry et al. | 445/5 |
| 4,764,704 | 8/1988 | New et al. | 313/414 |

*Primary Examiner*—Kenneth J. Ramsey

*Attorney, Agent, or Firm*—Joseph S. Tripoli; Dennis H. Irlbeck; Vincent J. Coughlin, Jr.

[57] ABSTRACT

The novel spot-knocking method for an electron gun mount assembly having a gun axis in an evacuated CRT comprises interconnecting a heater, a cathode, a control electrode and a screen electrode. Then, providing a magnetic field along the gun axis while applying spot-knocking voltages between an anode and the interconnected gun elements. The magnetic field facilitates the initiation of arcs parallel to the magnetic field and to the gun axis and between the adjacent gun elements, and inhibits the initiation of arcs in directions transverse to the magnetic field and the gun axis.

7 Claims, 3 Drawing Sheets

METHOD FOR SPOT-KNOCKING AN ELECTRON GUN MOUNT ASSEMBLY OF A CRT UTILIZING A MAGNETIC FIELD

This is a continuation-in-part of application serial no. 214,556 filed Jun. 29, 1988, now abandoned.

BACKGROUND OF THE INVENTION

The invention relates to a novel method for spot-knocking the electron gun mount assembly of a CRT (cathode-ray tube), and more particularly to a method of spot-knocking an electron gun mount assembly utilizing an axial magnetic field.

In the manufacture of a CRT, it is the practice to electrically process the electron gun mount assembly therein after the CRT has been completely assembled, exhausted of gases and sealed. One step in this electrical processing is spot-knocking, which involves inducing arcing in the gaps between adjacent electrodes, usually between a focus electrode and an electrode adjacent thereto. Arcing removes projections, burrs and/or particles which would later be sites for the field emission of electrons during the normal operation of the CRT. One problem encountered in this process is the initiation of arcs in the CRT in locations which by-pass the primary gaps between the adjacent electrodes. Typical of such unwanted arcing are arcs transverse to the electron gun longitudinal axis, such arcs occur between the elements of the electron gun and the neck glass of the CRT envelope.

U.S. Pat. No. 4,214,798 issued to L. F. Hopen on Jul. 29, 1980 discloses a conventional spot-knocking method that may be applied to bipotential or a tripotential electron gun structures. A bipotential gun structure typically has a heater and cathode K, a control grid G1, a screen grid G2, a single focus electrode G3 and a high voltage electrode, which is often designated as the anode or G4. Although separate elements may be provided for each of the three electron guns of a color picture tube, recent practice has tended to use common elements for the G1, the G2, the G3 and the anode of the three electron guns. A tripotential gun differs from a bipotential gun in that it employs three focus electrodes for the focusing action instead of only one. A tripotential gun typically has a heater, a cathode K, a control grid G1, a screen grid G2, three focus electrodes G3, G4 and G5, and an anode, which is often designated G6. In the method described in the Hopen patent, the heater, the cathode, the control grid and the screen grid are interconnected and, in the bipotential gun structure, spot-knocking voltages are applied between the anode and the interconnected gun elements with the focus electrode electrically floating. The tripotential electron gun is similar to the bipotential electron gun for the purpose of spot-knocking except that the G3 and G5 focus electrodes are interconnected within the CRT and two separate stem leads are connected to the G3 and G4 focus electrodes which are electrically floating during spot-knocking.

Many methods of spot-knocking electron gun assemblies have been used previously in attempts to improve the electrical characteristics of television pictures tubes. Most of these methods involve forcing arcs to occur between two adjacent electrodes to remove projections, burrs, and/or particles so that the field emission of electrons between the two elements is significantly reduced at the normal operating potentials. In all cases involving spot-knocking between the anode and the focus electrode G3, positive fluctuating DC high-voltage pulses are applied between these two electrodes with all other electrodes being held at ground potential or allowed to float, as described in the above-referenced Hopen patent. An alternative is to ground the anode and apply negative fluctuating DC high-voltage pulses to the remainder of the gun structure. The size, shape and repetition rate of the high-voltage pulses vary widely depending upon the nature of the spot-knocking equipment used. The voltage pulses used most frequently for spot-knocking are sinusoidal and are derived from the normal variation of the line voltage. They may be half wave with the lowest portion either at some minimum positive DC level or at ground potential, or they may be full wave, in which case the lowest value is usually clamped at ground potential. Very fast rise time pulses of short duration, sometimes derived from the discharge of a capacitor through a ball gap, have also been used in which current pulses often exceed 100 amperes. Although the power associated with these pulses is very high, the duration of each pulse (often less than one microsecond) limits the energy of the induced arc to levels which are safe for the tube elements. Regardless of the type of pulses used for the spot-knocking, most users have found it prudent to avoid the application of negative pulses to the anode.

In recent years, improvements in the focusing of the electron spot on the screen have been achieved by the use of increasingly higher voltages on the focusing elements of both bipotential and tripotential types. Because of these higher operating potentials, it is often necessary to provide for spot-knocking, between the focus electrode G3 and the scree grid G2, for tripotential types, spot-knocking among the various focus grids G3, G4 and G5 is also believed to be desirable.

In another spot-knocking method, described in U.S. Pat. No. 4,052,776 to R. Maskell et al., very high amplitude RF bursts are added to the fluctuating DC pulses of relatively low amplitude which are used to spot-knock between G2 and G3. In this method, the fluctuating DC spot-knocking voltage pulses are introduced through the stem lead to the G3 and G5 of a tripotential gun, and the RF burst is introduced through the remainder of the stem leads which are electrically connected. Because the stem leads are close to one another, either the peak DC voltages must be maintained at relatively low values which are of limited effectiveness, or special precautions must be taken to prevent electrical breakdown among the external portions of the stem leads.

Yet another spot-knocking method is described in U.S Pat. No. 4,682,963 to Daldry et al. A two-step conditioning process is disclosed for a CRT having six grids. During normal operation, the G2 and G4 are interconnected to a relatively low voltage. The G3 and G5 focus electrodes are interconnected at a higher potential and the anode, G6, operates at the highest potential. A general conditioning includes applying high voltage DC to the anode and applying pulse voltages to the interconnected G2 and G4 electrodes, the heater, the cathode, and the G1 are interconnected and allowed to float. The G3 and G5 are interconnected to each other and also allowed to float. During the second step of the processing, the heater, the cathode and the G1 through G5 electrodes, inclusive, are connected to the pulse voltage with a high voltage DC applied to the anode.

While several of the above-described spot-knocking methods relates to six element electron guns (in addition to the heater and the cathode), none provides an adequate means for conditioning a double bipotential electron gun. A double bipotential gun structure typically has a heater, a cathode K, a control grid G1, a screen grid G2, a first focus electrode G3, a first anode G4, a second focus electrode G5 and a second anode G6. The first and second focus electrodes, G3 and G5, typically operate at about 7 kV and the first and second anodes, G4 and G6, typically operate at about 25 kV. In some six electrode electron gun individual output leads are provided on the mount stem for the G3 and G5 focus electrodes to permit spot-knocking between the anode electrodes and at least one of the focus electrodes with the other focus electrode electrically floating. Such a process is described in my copending patent application, serial number 214,554 filed Jun. 29, 1988 and entitled, "METHOD FOR SPOT-KNOCKING AN ELECTRON GUN MOUNT ASSEMBLY OF A CRT". However, not all double bipotential gun structures are provided with a mount stem having individual output leads for the G3 and G5 focus electrodes. Instead, the G3 and G5 focus electrodes are frequently internally interconnected and transverse arcing between the interconnecting lead, the other gun elements and the neck glass of the CRT envelope occurs during spot-knocking. As a result, fewer beneficial arcs are generated across the gaps between adjacent electrodes so that projections, burrs and/or particles which create field emission sites are not completely removed from the electrodes. The same incomplete spot-knocking can occur in any electron gun where there is a tendency for transverse arc to be initiated between the electron gun elements and the neck glass of the CRT.

SUMMARY OF THE INVENTION

The novel method for spot-knocking a completed CRT having an electron gun with a plurality of gun elements arranged along a longitudinally extending gun axis includes the steps of interconnected selected ones of said gun elements, providing a magnetic field along the gun axis, and applying spot-knocking voltages between an anode and the interconnected gun elements.

DETAILED DESCRIPTION OF THE PREFERRED EMBODIMENTS

The novel spot-knocking method may be applied to any electron gun mount assembly of a cathode-ray tube, CRT, having a cathode and a plurality of electrodes for directing and focusing an electron beam. There may be a single electron gun or a plurality of guns in the mount assembly of the CRT. Where there is more than one gun, the guns may be in any geometric arrangement. Where there are three guns, as in a color television picture tube, for example, the guns may be arranged in a delta array or in an inline array as is known in the art.

Figure 1:
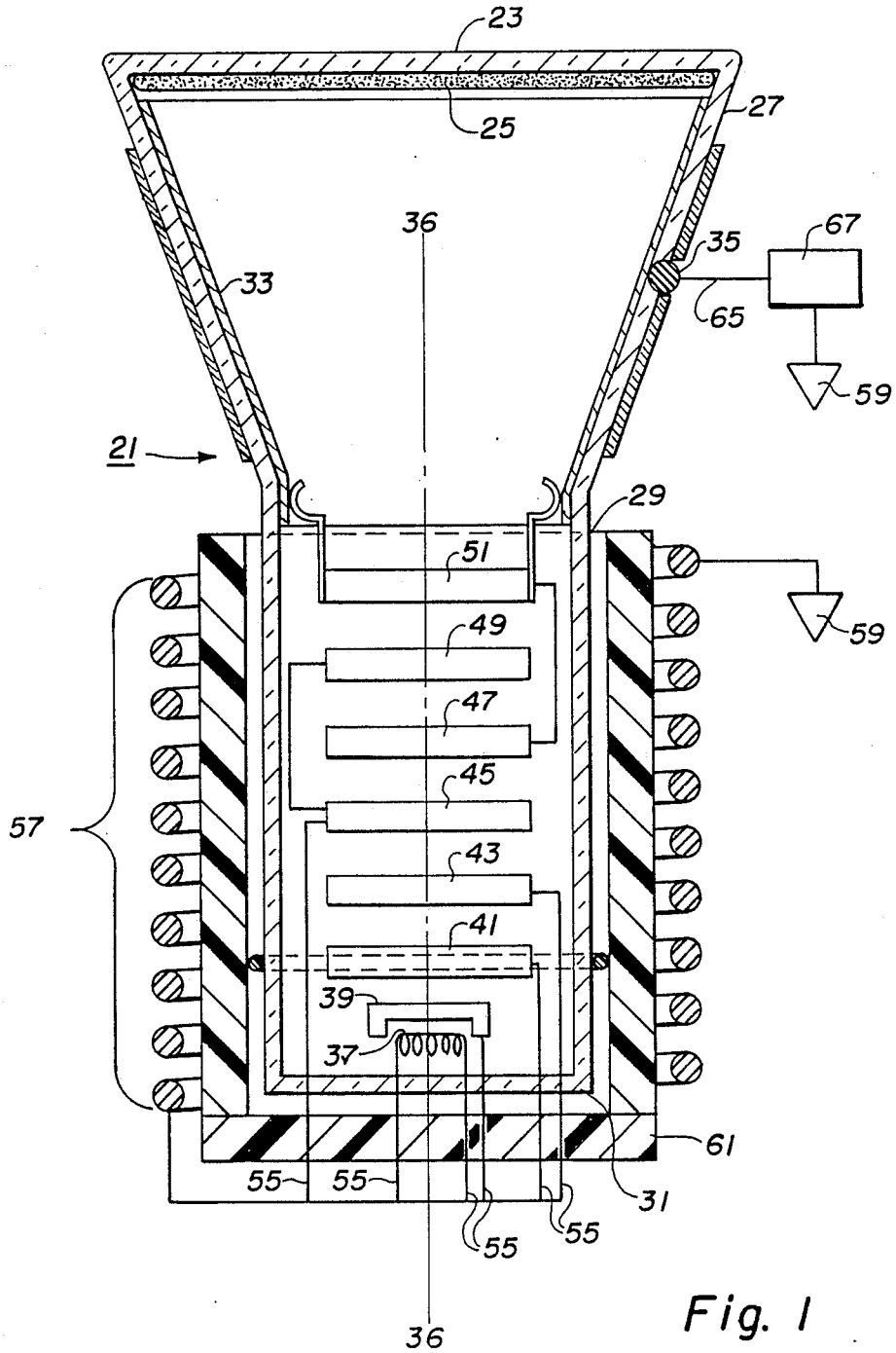
FIG. 1 shows a schematic representation of a first circuit including magnetic field means for practicing the novel method.

The novel method may be applied, for example, to a double bipotential electron gun of the type schematically represented in FIG. 1. The double bipotential gun structure typically has a heater, a cathode, a G1 or control grid electrode, a G2 or screen grid electrode, a G3 or first focus electrode, a G4 or first anode, a G5 or second focus electrode and a G6 or second anode. Although separate elements may be provided for each of the three electron guns of the CRT, recent practice has tended to use common elements attched to glass support rods (not shown). In the double bipotential electron gun, the focus electrodes G3 and G5 typically operate at a first voltage of about 7 kV, and the anodes G4 and G6 operate at a second voltage of about 25 kV.

FIG. 1 includes a schematic, sectional, elevational view of an evacuated CRT 21 including a faceplate panel 23 carrying on its inner surface a luminescent viewing screen 25. The panel 23 is sealed to the larger end of a funnel 27 having a neck 29 integral with the smaller end of the funnel 27. The neck 29 is closed by a stem 31. The inner surface of the funnel 27 carries a conductive coating 33 which contacts an anode button 35.

The neck 29 houses a double bipotential electron-gun mount assembly. This assembly includes three double bipotential guns only one of which is shown in FIG. 1 having a longitudinally extending gun axis 36. The mount assembly includes two glass support rods (not shown) from which the various gun elements are mounted in the following order. The gun elements of each gun include a heater 37, a cathode 39, a G1 or control electrode 41, a G2 or screen electrode 43, a G3 or first focus electrode 45, a G4 or first anode 47, a G5 or second focus electrode 49, and a G6 or second anode 51. The first and second focus electrodes 45 and 49 are internally electrically interconnected as are the first and second anodes, 47 and 51. The second anode 51 is connected to the conductive coating 33 by means of snubbers 53.

In the preferred embodiment, the heater 37, the cathode 39, the G1 electrode 41, the G2 electrode 43 and the G3 electrode 45 are connected to separate stem leads 55 which extend through the stem 31. The leads 55 of the aforementioned gun elements are interconnected and electrically connected to one end of a solenoid 57 which extends along the neck 29 to generate a magnetic field of about 1000 gauss parallel to the gun axis 36. during spot-knocking, the stem 31 and the stem leads 55 are inserted into a base (not shown). The other end of the solenoid is connected to ground 59. An insulative member 61 is disposed between the solenoid and the neck of the tube. The anode button 35 is connected through an anode lead 65 to a source 67 of low frequency pulsed spot knocking voltage and then to ground. The pulses rise from ground initially to peaks of about minus $35\pm5$ kilovolts increasing to peaks of about minus $60\pm5$ kilovolts in 90 to 120 seconds. The pulses are comprised of half-wave rectified AC voltage having a frequency of about 60 hertz. The positive portion of the AC voltage is clamped to ground. The total duration of the pulses may be in the range of 0.1 to 0.2 second (6 to 12 cycles) and the time spacing may be in the range of 0.5 to 1.0 second.

The magnetic field parallel to the gun axis 36 provided by the solenoid 57 facilitates longitudinal arcs across the gaps between adjacent elements of the electron gun; however, the magnetic field has sufficient strength so that it quenches or suppresses arcs initiated in directions transverse to the tube axis. The net result of spot-knocking with the aid of an axial magnetic field is to concentrate arcing in the main gaps between adjacent electrodes thus enhancing the effectiveness of spot-knocking.

While a solenoid 57 is shown in FIG. 1 as the means for providing the axial magnetic field, a suitable cylindrical magnet, insulated from the neck 29 of the CRT, may also be used, in which event, the interconnected gun elements are connected directly to ground 59.

Figure 2:
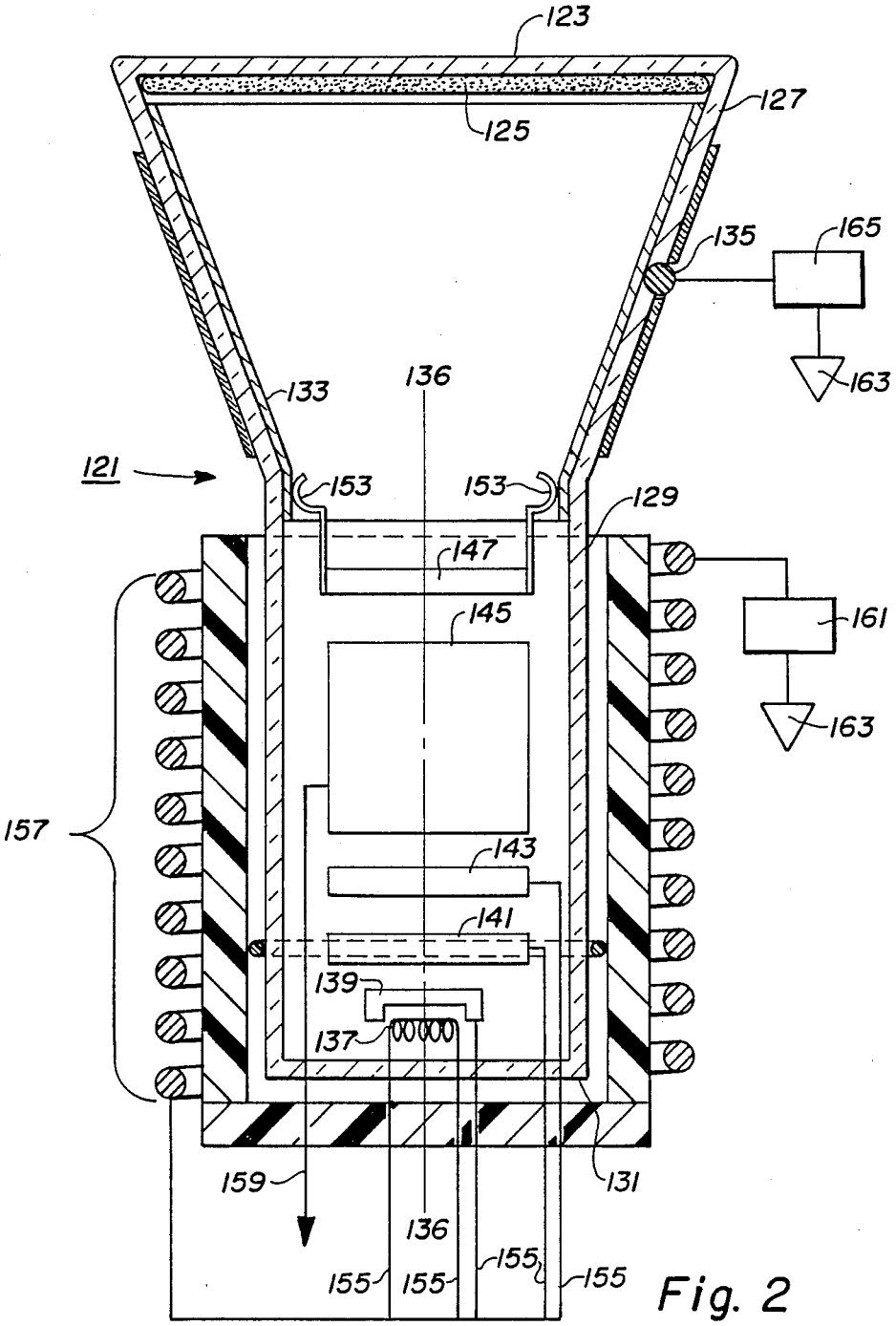
FIG. 2 shows a schematic representation of a second circuit including magnetic field means for practicing the novel method.

FIG. 2 includes a schematic, sectional, elevational view of an alternative embodiment of a CRT 121 including a faceplate panel 123 having a luminescent viewing screen 125 on its inner surface. As in the previous embodiment, the panel 123 is sealed to a funnel 127 having a neck 129 integral with the smaller end thereof. The neck 129 is closed by a stem 131. a conductive coating 133 is disposed on the inner surface of the funnel 127 and contacts the anode button 135.

The neck 129 houses a bipotential electron-gun mount assembly of the type described in U.S. Pat. No. 3,772,554 to R. H. Hughes having a longitudinally extending gun axis 136. This assembly includes three bipotential guns only one of which is shown. The mount assembly includes two glass support rods, not shown, from which the various gun elements are mounted. The gun elements of each gun include a heater 137, a cathode 139, a G1 or control electrode 141, a G2 or screen electrode 143, a G3 or focus electrode 145 and a G4 or anode 147. The anode 147 is connected to the conductive coating 133 by means of snubbers 153. The heater 137, the cathode 139, the G1 electrode 141 and the G2 electrode 143 are connected to separate stem leads 155 which extend through the stem 131. The leads 155 of the aforementioned gun elements are interconnected and electrically connected to one end of a solenoid 157 which extends along the neck 129 to generate a magnetic field parallel to the gun axis 136. The G3 electrode 145 is connected to a separate G3 stem lead 159 which extends through the stem 131. During spot-knocking, the stem 131 and the stem leads 155 and 159 are inserted into a base (not shown). The G3 stem lead 159 is electrically floating. The other end of the solenoid 157 is connected to a source 161 of high frequency voltage pulses of short duration and fast rise time. The other end of the source 161 is connected to ground 163. The pulses from the source 161 comprise potentials in the range of 92 and 150 kilovolts (kV) AC at a frequency of 350 kilohertz. A voltage of about +45 kV from a source 165 is connected to the anode button 135.

Figure 3:
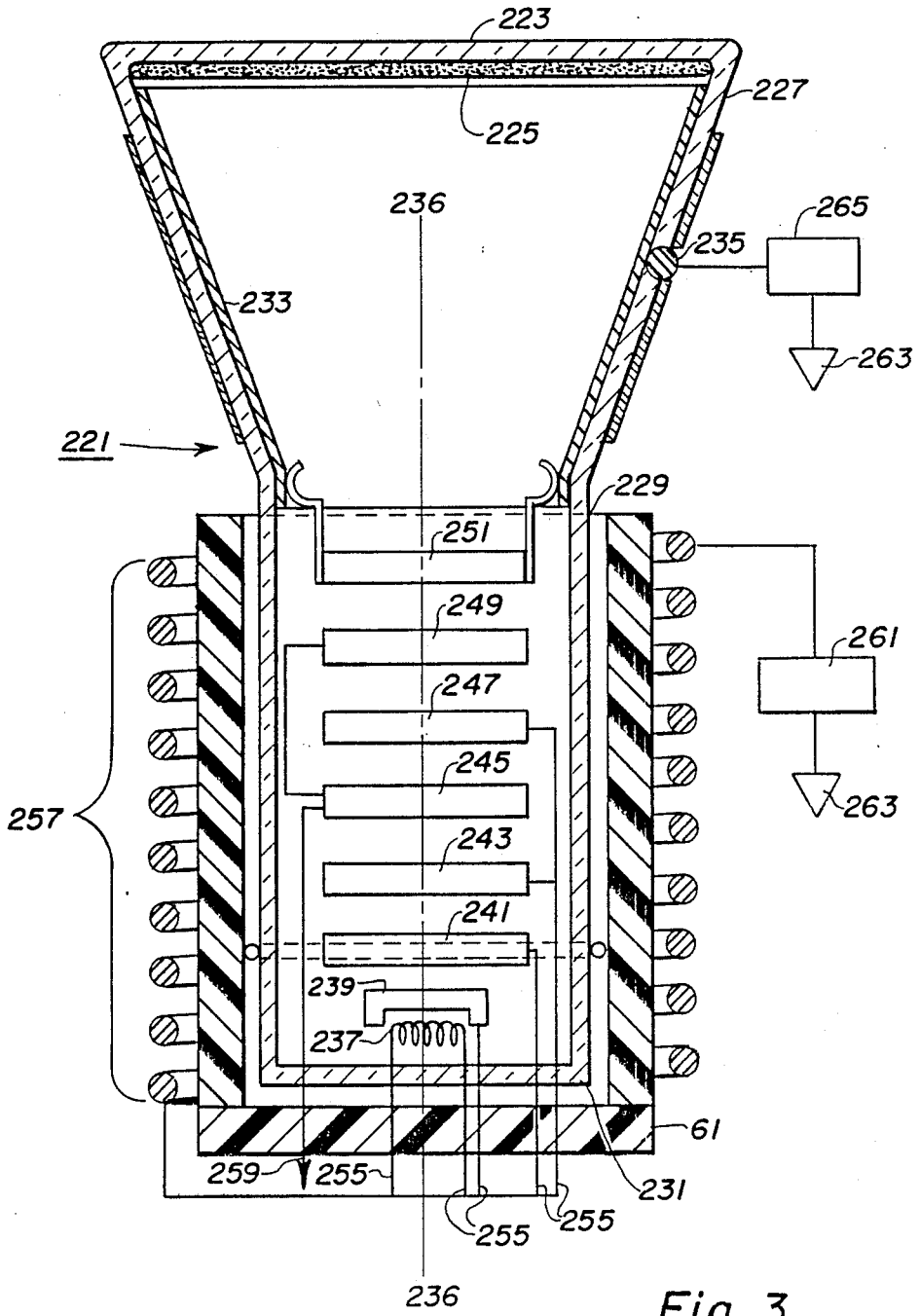
FIG. 3 shows a schematic representation of a third circuit including magnetic field means for practicing the novel method.

FIG. 3 includes a schematic, sectional, elevational view of an alternative embodiment of a CRT 221 including a faceplate panel 223 having a luminescent viewing screen 225 on its inner surface.

As in the previous embodiments, the panel 223 is sealed to a funnel 227 having a neck 229 integral with the smaller end thereof. The neck 229 is closed by a stem 231. A conductive coating 233 is disposed on the inner surface of the funnel 227 and contacts the anode button 235.

The neck 229 houses a plural-element electron gun mount assembly which operates with the second and fourth grids interconnected and the third and fifth grids interconnected, such an assembly is shown in U.S. Pat. No. 4,764,704, issued to D. A. New et al., on Aug. 16, 1988. Typically during normal operation, a potential within the range of 300V to 1000V is applied to the G2 and G4 electrodes, 7 kV is applied to the G3 and G5 electrodes, and 25 kV is applied to the anode. This assembly includes three multipotential electron guns, only one of which is shown. The mount assembly includes two glass support rods, not shown, to which the various gun elements are attached. The elements of each gun include a heater 237, a cathode 239, a G1 or control electrode 241, a G2 or screen electrode 243, a G3 electrode 245, a G4 electrode 247, a G5 electrode 249 and a G6 electrode or anode 251. The heater 237, the cathode 239, the G1 electrode 241 and the G2 and G4 electrodes 243 and 247, respectively, are connected to separate stem leads 255 which extend through the stem 231. For spot-knocking purposes, the leads 255 of the aforementioned gun elements are interconnected and electrically connected to one end of a solenoid 257 which extends along the neck 229 to generate a magnetic field parallel to the gun axis 236. The G3 and G5 electrodes 245 and 249, respectively, are interconnected to a separate stem lead 259 which extends through the stem 231. During spot-knocking, the stem 231 and the stem leads 255 and 259 are inserted into a base, not shown. The stem lead 259 is electrically floating. The other end of the solenoid 257 is connected to a source 261 of high frequency voltage pulses of short duration and fast rise time. The other end of the source 261 is connected to ground 263. The pulses from the source 261 comprise potentials in the range of 92 to 150 kV (AC) at a frequency of 350 kilohertz (kHz). A voltage of about +45 kV from a source 265 is connected to the anode button 235. The other end of the source 265 is connected to ground 263.

What is claimed is:

1. In a method for spot-knocking a completed CRT having an electron gun with a plurality of spaced apart gun elements including a heater, a cathode, a control electrode, a screen electrode, at least one focus electrode and at least one anode arranged along a longitudinally extending gun axis, the steps comprising interconnecting selected ones of the gun elements including at least said heater, said cathode, said control electrode and said screen electrode, providing a magnetic field along said gun axis, and applying spot-knocking voltages between said anode and the interconnected gun elements.

2. In a method for spot-knocking a completed CRT having an electron gun with a plurality of spaced apart gun elements including a heater, a cathode, a control electrode, a screen electrode, at least one focus electrode and at least one anode arranged along a longitudinally extending gun axis, the steps comprising interconnecting selected ones of the gun elements including at least said heater, said cathode, said control electrode and said screen electrode, providing a magnetic field along said gun axis, and applying spot-knocking voltages between said anode and the interconnected gun elements, whereby said magnetic field facilitates the initiation of arcs parallel to the magnetic field and between the adjacent gun elements, and inhibits the initiation of arcs in directions transverse to the magnetic field and the gun axis.

3. The method as described in claim 2, wherein said electron gun comprises a bipotential electron gun wherein said focus electrode is electrically floating.

4. The method as described in claim 2, wherein said electron gun comprises a double bipotential electron gun having two interally interconnected focus electrodes and two internally interconnected anodes, said focus electrodes being externally connected to the interconnected gun elements.

5. In a method for spot-knocking a completed CRT having an electron gun with a plurality of spaced apart gun elements including a heater, a cathode, a control electrode, a screen electrode, a G3 electrode, a G4 electrode, a G5 electrode and an anode arranged along a longitudinally extending gun axis, the steps comprising interconnecting selected ones of the gun elements including at least said heater, said cathode, said control electrode and said G4 electrode, providing a magnetic field along said gun axis, and applying spot-knocking voltages between said anode and the interconnected gun elements, whereby said magnetic field facilitates the initiation of arcs parallel to the magnetic field.

6. The method as described in claim 5, wherein said G3 and G5 electrodes are electrically floating.

7. The method as described in claim 6, wherein said G3 and G5 electrodes are connected together.

* * * * *

UNITED STATES PATENT AND TRADEMARK OFFICE
CERTIFICATE OF CORRECTION

PATENT NO. : 4,883,437

DATED : Nov. 28, 1989

INVENTOR(S) : Karl G. Hernqvist

It is certified that error appears in the above-identified patent and that said Letters Patent is hereby corrected as shown below:

Patent

Col. 2, line 34, change "scree" to --screen--.

Col. 4, line 47, change "during" to --During--.

Col. 5, line 17, change "a" to --A--.

Signed and Sealed this

Twentieth Day of November, 1990

*Attest:*

HARRY F. MANBECK, JR.

*Attesting Officer*

*Commissioner of Patents and Trademarks*